US011299846B2

(12) United States Patent
Hayashida et al.

(10) Patent No.: US 11,299,846 B2
(45) Date of Patent: Apr. 12, 2022

(54) CLOTH SPREADING DEVICE

(71) Applicant: PUREX Co., Ltd., Kagawa (JP)

(72) Inventors: Yoo Hayashida, Kagawa (JP); Hiroyuki Ideue, Kagawa (JP)

(73) Assignee: PUREX CO., LTD., Kagawa (JP)

( * ) Notice: Subject to any disclaimer, the term of this patent is extended or adjusted under 35 U.S.C. 154(b) by 31 days.

(21) Appl. No.: 16/647,920

(22) PCT Filed: Jul. 19, 2018

(86) PCT No.: PCT/JP2018/027052
§ 371 (c)(1),
(2) Date: Mar. 17, 2020

(87) PCT Pub. No.: WO2019/064840
PCT Pub. Date: Apr. 4, 2019

(65) Prior Publication Data

US 2020/0263347 A1 Aug. 20, 2020

(30) Foreign Application Priority Data

Sep. 27, 2017 (JP) ..... JP2017-187007

(51) Int. Cl.
*D06F 67/04* (2006.01)

(52) U.S. Cl.
CPC ..... *D06F 67/04* (2013.01)

(58) Field of Classification Search
CPC ..... D06F 67/04
See application file for complete search history.

(56) References Cited

U.S. PATENT DOCUMENTS

| | | | | |
|---|---|---|---|---|
| 10,246,814 | B2 * | 4/2019 | Maejima | D06F 67/04 |
| 10,815,612 | B2 * | 10/2020 | Tanii | D06F 67/04 |
| 10,975,517 | B2 * | 4/2021 | Nakamura | D06F 67/04 |
| 2017/0335505 | A1 | 11/2017 | Maejima | |

(Continued)

FOREIGN PATENT DOCUMENTS

| | | | |
|---|---|---|---|
| EP | 1820894 | A1 | 8/2007 |
| JP | 2006-149491 | A | 6/2006 |

(Continued)

OTHER PUBLICATIONS

WIPO, International Search Report for PCT Patent Application No. PCT/2018/027052, dated Oct. 9, 2018.

*Primary Examiner* — Lynn E Schwenning

(57) ABSTRACT

To provide a cloth spreading device capable of shortening the waiting time until inputting work of a worker and achieving high production efficiency. A cloth spreading device 1 includes: a plurality of input units 30; a plurality of relay units 40 provided corresponding to the input units 30; and an extension unit 50. Each of the input units 30 includes: an input chuck 31; and an up-down moving machine 32 that moves the input chuck 31 up and down. Each of the relay units 40 receives a cloth C from the input chuck 31 having moved up to a transfer position and transfers the received cloth C to the extension unit 50. The input chuck 31 having transferred the cloth C to the relay unit 40 moves down to an input position. Standby time of the input chuck 31 until the relay unit 40 becomes ready to receive the cloth C can be shortened so that the input chuck 31 can be moved down without delay to the input position.

11 Claims, 15 Drawing Sheets

(56) References Cited

U.S. PATENT DOCUMENTS

| | | | | |
|---|---|---|---|---|
| 2020/0002865 | A1* | 1/2020 | Yano | D06C 3/00 |
| 2020/0173097 | A1* | 6/2020 | Hayashida | D06C 3/00 |

FOREIGN PATENT DOCUMENTS

| | | | |
|---|---|---|---|
| JP | 2007-92255 | A | 4/2007 |
| JP | 2009-249761 | A | 10/2009 |
| WO | 2016/084401 | A1 | 6/2016 |

* cited by examiner (1)

(2)

(3)

(4)

(5)

(7)

(8)

(9)

CLOTH SPREADING DEVICE

TECHNICAL FIELD

This invention relates to a cloth spreading device. More specifically, this invention relates to a cloth spreading device for spreading a cloth such as a washed sheet, quilt cover (two-sheet quilt cover), pillow cover, towel, or tablecloth, and inputting the spread cloth into a device for a subsequent step.

BACKGROUND ART

Abundant sheets are used in hotels, hospitals, etc. The used sheets are washed and ironed in laundry plants. Then, these sheets are used again in hotels, hospitals, etc. Work done in the laundry plants includes washing of cloths such as sheets, and then ironing of the washed cloths using roll ironers or folding of the washed cloths using folding machines. To supply the cloths to these devices, the cloths are required to be spread in advance. If a worker is responsible for the work of spreading cloths, the worker is required to spend a great deal of time and effort in that work. Hence, in recent years, this work has been done using a cloth spreading device.

The outline of the configuration of a cloth spreading device disclosed in patent literature 1 is as follows.

The cloth spreading device includes four input chucks. When a worker attaches a cloth to the input chuck, the input chuck moves up and is placed on standby. A transversely moving chuck moves to a position facing the input chuck, receives the cloths, and moves to a machine frame center position. A transfer device located in a central area of the machine frame transfers the cloth held by the transversely moving chuck to an extending chuck. The extending chuck extends and hangs the cloth, thereby spreading the cloth into a rectangular shape. The cloth in this state is retracted to the inside of the device and then ejected to a device for subsequent processes.

CITATION LIST

Patent Literature

Patent Literature 1: Japanese Patent Application Publication No. 2006-149491

SUMMARY OF INVENTION

Technical Problem

In the cloth spreading device of Patent Literature 1, after the input chuck gripping the cloth moves up, the input chuck is on standby until the cloth is transferred to the transversely moving chuck. During the standby, the worker is prohibited from doing the work of attaching a next cloth to the input chuck. This generates waiting time for the worker and causes inefficiency.

In view of the foregoing circumstances, this invention is intended to provide a cloth spreading device capable of shortening the waiting time until inputting work of a worker and achieving high production efficiency.

Solution to Problem

A cloth spreading device according to a first invention includes: a plurality of input units for inputting of a cloth by a worker; a plurality of relay units provided corresponding to each of the input units; and an extension unit that spreads the cloth. Each of the input units includes: an input chuck that grips the cloth; and an up-down moving machine that moves the input chuck up and down. Each of the relay units receives the cloth from the input chuck having moved up to a transfer position and transfers the received cloth to the extension unit. The input chuck having transferred the cloth to the relay unit moves down to an input position.

The cloth spreading device according to a second invention is characterized in that, in the first invention, each of the relay units includes: a relay chuck provided behind the input chuck having moved up to the transfer position; and a driver that moves the relay chuck between a forward position for transfer of the cloth from the input unit and a backward position for transfer of the cloth to the extension unit.

The cloth spreading device according to a third invention is characterized in that, in the second invention, the driver of the relay unit includes: a circling member with a tip portion to which the relay chuck is attached; and an actuator that causes the circling member to circle.

The cloth spreading device according to a fourth invention is characterized in that, in the second or third invention, the extension unit includes: extension chucks in a pair that grip corner portions al opposite ends of one side of the cloth; and a transversely moving machine that moves the extension chucks in a pair transversely behind the relay units. The extension chucks in a pair move to positions behind one of the relay units and receives the cloth from the one relay unit.

Advantageous Effects of Invention

According to the first invention, a relay unit is provided for each corresponding input unit. This makes it possible to shorten the standby time of the input chuck until the relay unit becomes ready to receive the cloth. Thus, the input chuck can be moved down without delay to the input position. As a result, the waiting time of a worker until the next inputting work can be shortened to achieve an increase in the production efficiency of the cloth spreading device.

According to the second invention, moving the relay chuck forward and backward allows for the transfer of the cloth from the input unit to the extension unit.

According to the third invention, causing the circling member to circle allows the relay chuck to move between the forward position and the backward position.

According to the fourth invention, the extension chucks in a pair can receive the cloth from any relay unit by moving transversely.

DESCRIPTION OF EMBODIMENTS

An embodiment of this invention will be described next based on the drawings.

A cloth spreading device 1 according to the embodiment of this invention is a device for spreading a large square cloth C such as a washed sheet, quilt cover (two-sheet quilt cover), pillow cover, towel, or tablecloth, and supplying the spread cloth C into a device for a subsequent step such as a roll ironer. In this description, a forward-backward direction, a right-to-left direction, and a top-to-bottom direction of the cloth spreading device are defined in the manner shown in FIGS. 1 and 2.

(Basic Configuration)

A basic configuration of the cloth spreading device 1 will be described next together with its operation.

Figure 1:
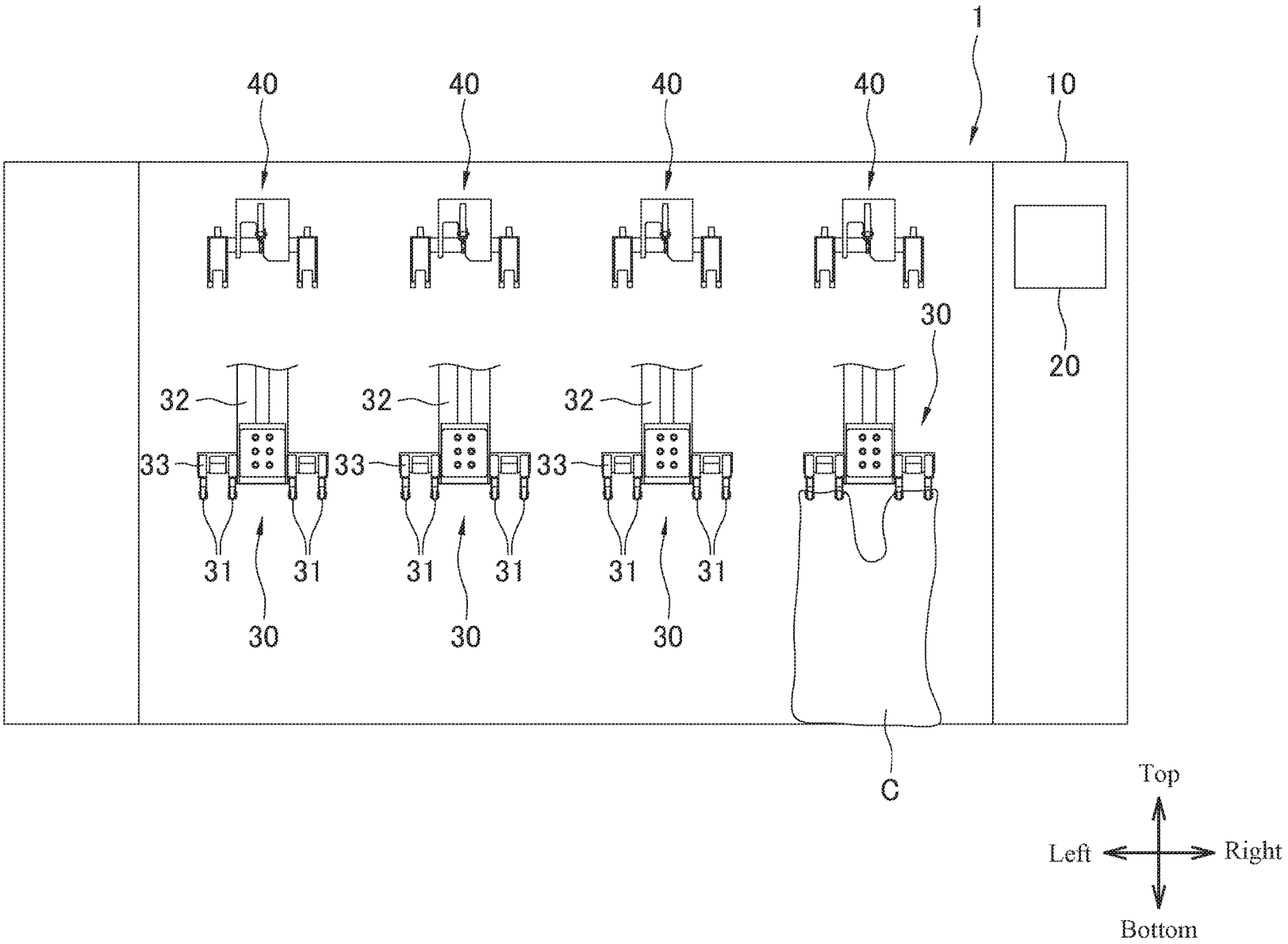
FIG. 1 is a front view of a cloth spreading device according to an embodiment of this invention.
Figure 2:
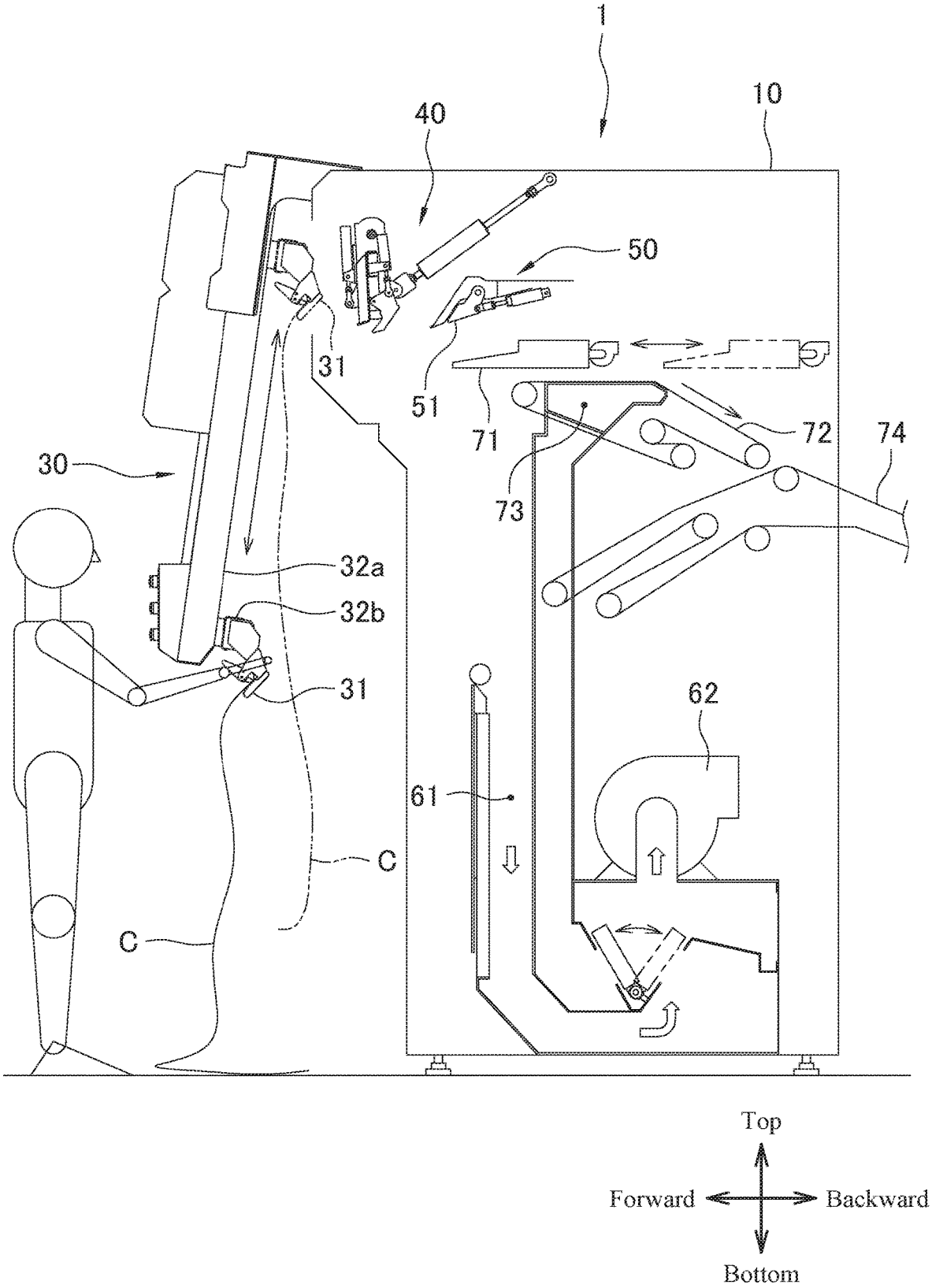
FIG. 2 is a side view of the cloth spreading device shown in FIG. 1.

As shown in FIGS. 1 and 2, the cloth spreading device 1 includes a machine frame 10. The cloth spreading device 1 includes a controller 20 that controls operations of various types of units described below. The controller 20 is a computer including a CPU, a memory, etc.

The machine frame 10 has a front side provided with an input unit 30 for inputting of the cloth C by a worker. The input unit 30 includes an input chuck 31 that grips the cloth C and an up-down moving machine 32 that moves the input chuck 31 up and down. The up-down moving machine 32 includes a body part 32*a* and an up-down moving part 32*b* and can move the up-down moving part 32*b* up and down along the body part 32*a*. A chuck base 33 supporting the input chuck 31 is fixed to the up-down moving part 32*b*.

The chuck base 33 has a width comparable to the width of human shoulders. The input chucks 31, 31 in a pair are provided at each of right and left ends of the chuck base 33. The input chucks 31, 31 in a pair grip a corner portion at each of opposite ends of one side of the cloth C.

As the up-down moving machine 32 is actuated, the input chuck 31 moves up and down between an input position (solid lines in FIG. 2) at which the worker attaches the cloth C to the input chuck 31, and a transfer position (alternating long and two short dashed lines in FIG. 2) as a top position as a destination of the upward movement. When the worker attaches the cloth C by hand to the input chuck 31, the up-down moving machine 32 moves up the cloth C together with the input chuck 31.

The cloth spreading device 1 includes a plurality of the input units 30. In this embodiment, four input units 30 are provided, and each of the input units 30 is configured to allow inputting of the cloth C therethrough.

A plurality of relay units 40 are provided corresponding to each of the input units 30. The number of the relay units 40 is the same as that of the input units 30. In this embodiment, four relay units 40 are provided. The relay unit 40 is arranged behind the input chuck 31 having moved up to the transfer position. Each relay unit 40 has the function of receiving the cloth C from a corresponding input unit 30 and transferring the received cloth C to an extension unit 50. The configuration of the relay unit 40 will be described later.

Figure 3:
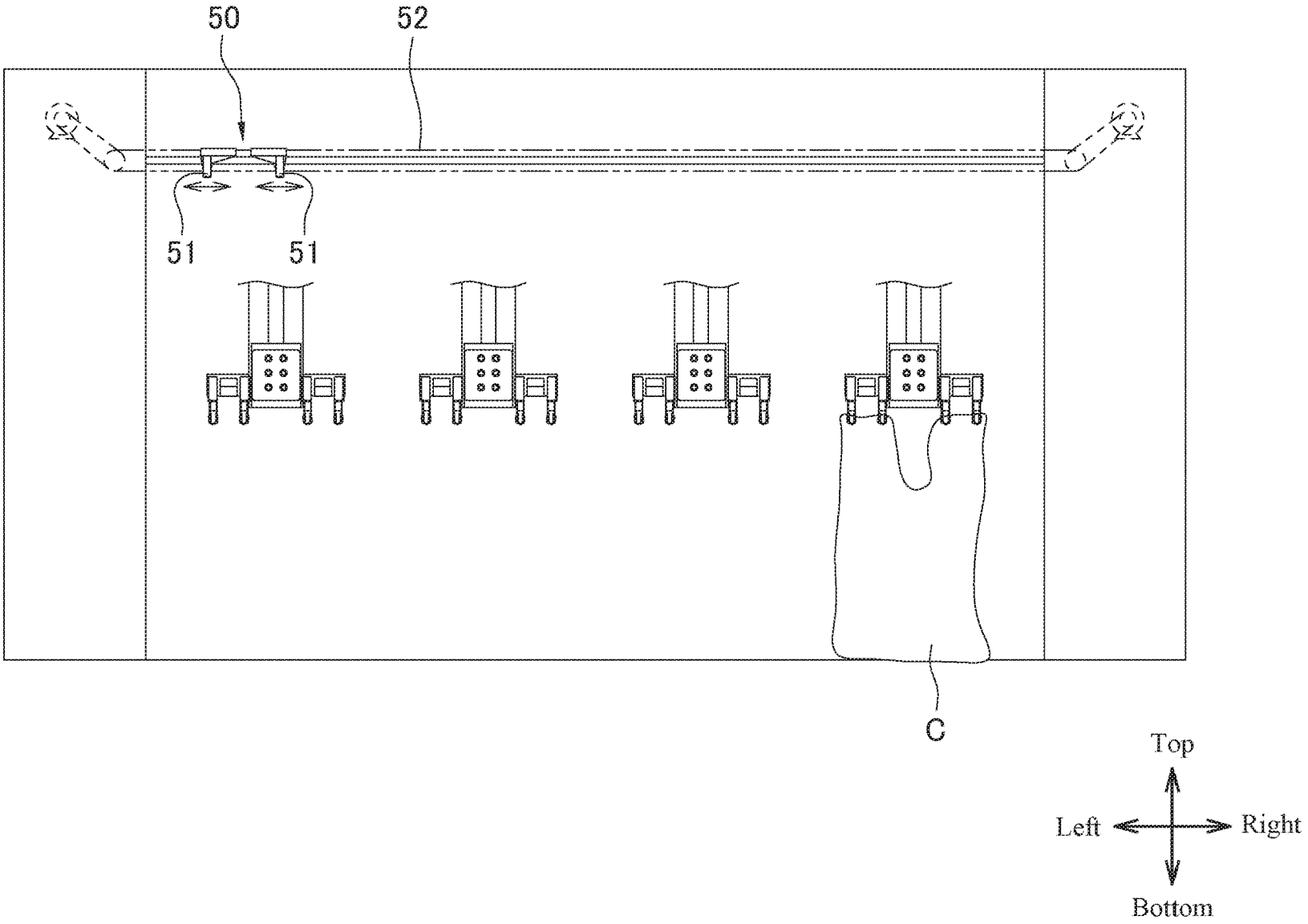
FIG. 3 is a front view of the cloth spreading device shown in FIG. 1 without a relay unit.

The extension unit 50 for spreading the cloth C is provided behind the relay unit 40. As shown in FIG. 3, the extension unit 50 includes extension chucks 51, 51 in a pair that grip corner portions at opposite ends of one side of the cloth C, and a transversely moving machine 52 that moves the extension chucks 51, 51 in a pair transversely and independently. Each extension chuck 51 moves transversely behind the relay units 40.

Figure 4:
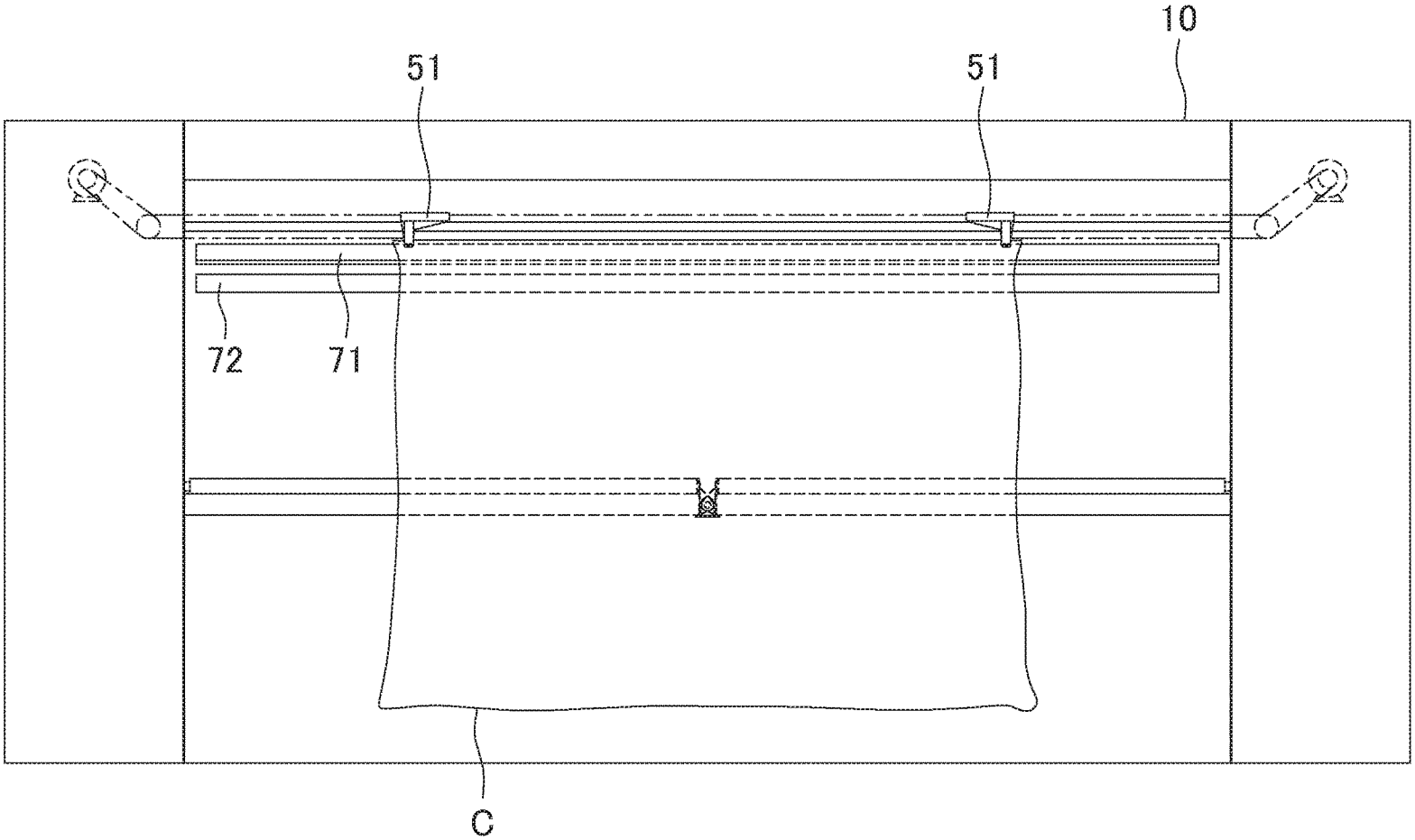
FIG. 4 is an explanatory view showing a cloth in a state of being spread and hung by an extension unit.

As shown in FIG. 2, when the worker attaches the cloth C by hand to the input chuck 31, the input chuck 31 moves up while gripping the cloth C. When the input chuck 31 has moved up to the transfer position, the cloth C is transferred from the input chuck 31 to the relay unit 40. Then, the cloth C is transferred from the relay unit 40 to the extension chucks 51, 51. The extension chucks 51, 51 in a pair move transversely so as to be separated to the right and left. By doing so, the cloth C is hung in a spread state (state shown in FIG. 4).

A shaping duct 61 and a blower 62 connected to the shaping duct 61 are provided at lower positions of the machine frame 10. While corner portions at opposite ends of the cloth C are gripped by the extension chucks 51, 51, a lower portion of the cloth C is sucked into the shaping duct 61. In this way, creases are removed from the cloth C.

A vacuum box 71 capable of moving forward and backward is arranged below the extension unit 50. A primary conveyor 72 is arranged below the vacuum box 71. A vacuum box 73 is arranged below a conveyor surface of the primary conveyor 72. A secondary conveyor 74 is connected to the primary conveyor 72 at the back of the primary conveyor 72.

After the creases are removed by the shaping duct 61, the vacuum box 71 is moved forward to contact the cloth C. Further, when the extension chucks 51, 51 are opened, an upper edge of the cloth C is attached by suction to the vacuum box 71. When the vacuum box 71 is moved backward thereafter, the upper edge of the cloth C is moved from the vacuum box 71 onto the primary conveyor 72. At this time, the vacuum box 73 is operating so the cloth C is attached under suction to the primary conveyor 72. By the actuation of the primary conveyor 72 and the secondary conveyor 74, the cloth C is fed backward. In this way, the spread cloth C can be supplied to the device for a subsequent step.

(Relay Unit)

The configuration of the relay unit 40 will be described next.

Figure 5A:
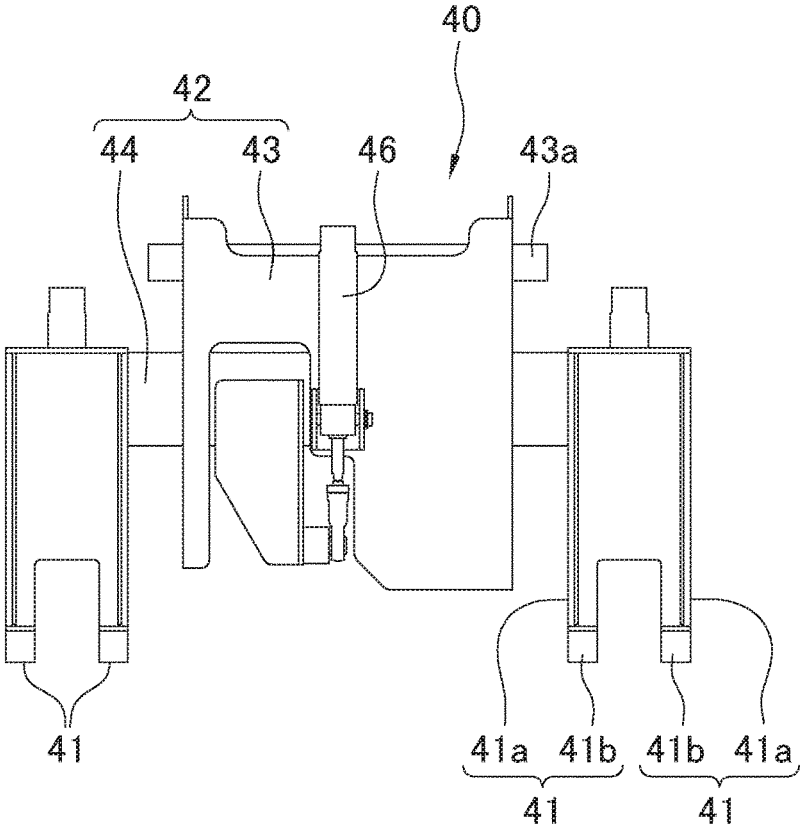
FIG. 5A is a front view of the relay unit with a circling member in a contracted state.
Figure 6A:
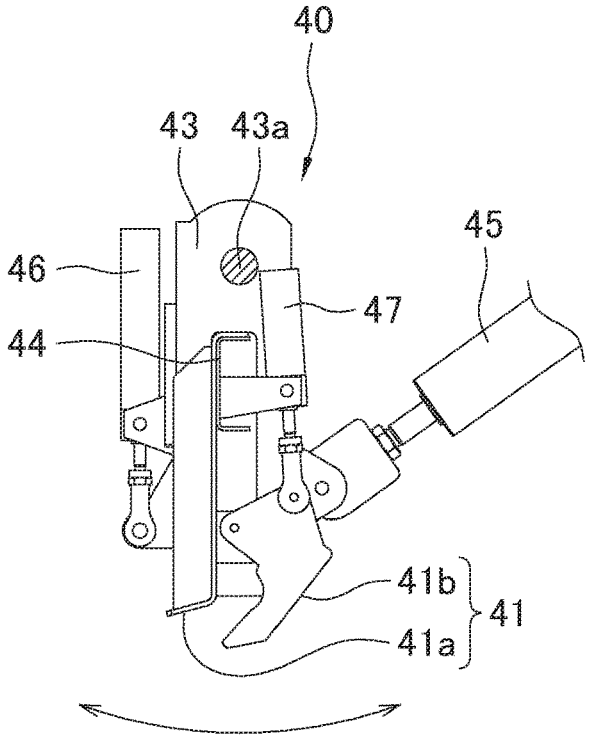
FIG. 6A is a side view of the relay unit with the circling member in a contracted state.

As shown in FIGS. 5A and 6A, the relay unit 40 includes a relay chuck 41 and a circling member 42 to which the relay chuck 41 is attached. The circling member 42 is constructed of a base 43 and a slider 44. The base 43 is provided with a rotary axis 43*a*. The rotary axis 43*a* is rotatably supported on the machine frame 10, and the circling member 42 as a whole can circle about the rotary axis 43*a*.

An end portion of the circling member 42 with the rotary axis 43*a* (upper end portion in FIGS. 5A and 6A) is called a "base end." An end portion of the circling member 42 on the opposite side (lower end portion in FIGS. 5A and 6A) is called a "tip." The relay chuck 41 is provided at a tip portion of the circling member 42.

A rod tip portion of a circling cylinder 45 is rotatably provided on the back surface of the base 43. The other end of the circling cylinder 45 is arranged on the machine frame 10 (see FIG. 2). Stretching and contracting the circling cylinder 45 allows the circling member 42 to circle forward and backward.

Causing the circling member 42 to circle forward and backward allows the relay chuck 41 to move forward and backward. In the following, a destination position of the forward movement of the relay chuck 41 will be called a "forward position," and a destination position of the backward movement of the relay chuck 41 will be called a "backward position." A particular position between the forward position and the backward position will be called a "standby position." Causing the circling member 42 to circle allows the relay chuck 41 to move between the forward position and the backward position.

As an example, an air cylinder may be used as the circling cylinder 45. If a double-rod cylinder is used as the circling cylinder 45, the circling member 42 is easily held in three postures. For example, stretching both of the rods places the circling member 42 in a posture of circling forward to allow the relay chuck 41 to be disposed at the forward position. Contracting both of the rods places the circling member 42 in a posture of circling backward to allow the relay chuck 41 to be disposed at the backward position. Stretching one of the rods and contracting the other rod places the circling member 42 in a downward suspended posture to allow the relay chuck 41 to be disposed at the standby position.

The circling cylinder 45 corresponds to an "actuator that causes a circling member to circle" described in CLAIMS. A structure including the circling member 42 and the circling cylinder 45 corresponds to a "driver" described in CLAIMS.

Figure 5B:
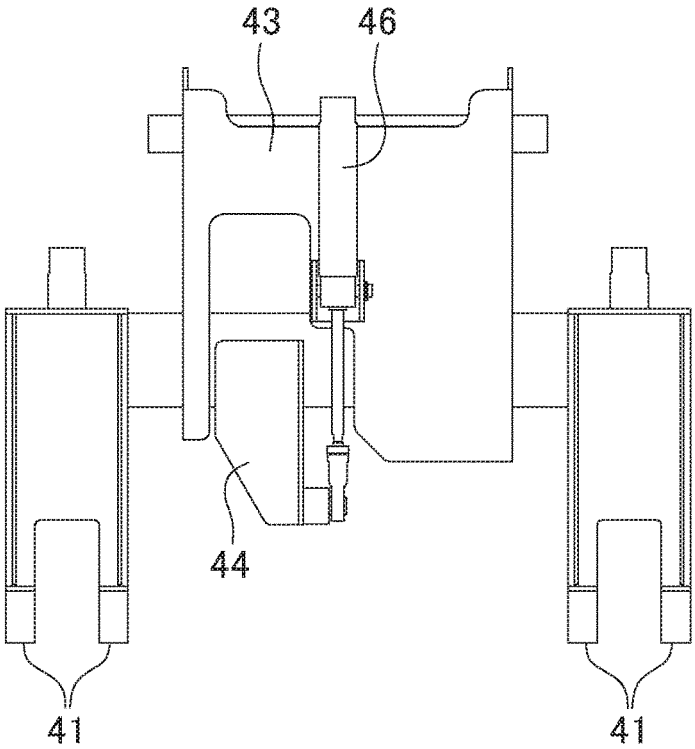
FIG. 5B is a front view of the relay unit with the circling member in a stretched state.
Figure 6B:
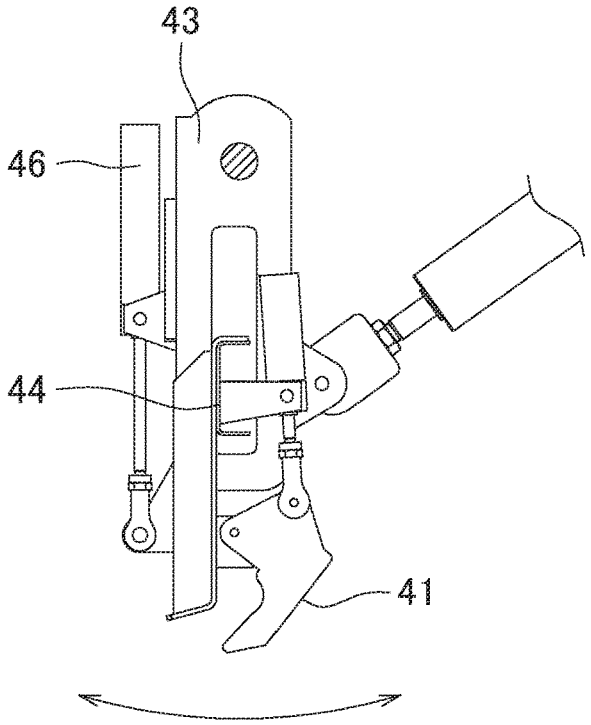
FIG. 6B is a side view of the relay unit with the circling member in a stretched state.

The slider 44 is slidable relative to the base 43 in a radial direction of circling motion (top-to-bottom direction in FIGS. 5A and 6A). A stretchable cylinder 46 is provided between the base 43 and the slider 44. Stretching and contracting the stretchable cylinder 46 allows the slider 44 to slide relative to the base 43. This makes it possible to stretch and contract the circling member 42 in the radial direction of circling motion. FIGS. 5A and 6A show a state in which the circling member 42 is in a contracted state. FIGS. 5B and 6B show a state in which the circling member 42 in a stretched state.

The relay chucks 41, 41 are provided in a pair at each of right and left ends of the slider 44. A narrow gap is determined between the relay chucks 41, 41 in a pair provided at one end of the slider 44 so as to allow the relay chucks 41, 41 to be inserted between the input chucks 31, 31 (see FIG. 1) in a pair provided at one end of the chuck base 33. The relay chucks 41, 41 in a pair are inserted between the input chucks 31, 31 in a pair, and the relay chucks 41, 41 receive the cloth C from the input chucks 31, 31.

Each relay chuck 41 includes a fixed pawl 41*a* and a movable pawl 41*b*. The fixed pawl 41*a* is fixed to the slider 44. The movable pawl 41*b* is provided so as to be capable of circling relative to the fixed pawl 41*a*. The movable pawl 41*b* is caused to circle by the actuation of an open-close cylinder 47. In response to the circling motion of the movable pawl 41*b*, a tip portion of the fixed pawl 41*a* and a tip portion of the movable pawl 41*b* are opened and closed relative to each other. An open-close part of the relay chuck 41 is pointed outward in the radial direction of the circling motion of the circling member 42.

Closing the fixed pawl 41*a* and the movable pawl 41*b* relative to each other allows the relay chuck 41 to grip the cloth C. Opening the fixed pawl 41*a* and the movable pawl 41*b* relative to each other allows for the release of cloth C from the grip of the relay chuck 41.

(Operation)

The operation of the cloth spreading device 1 will be explained next based on FIGS. 7 to 15.

The controller 20 operates various types of units in the cloth spreading device 1 according to the following procedure. In response to this, the cloth spreading device 1 processes the cloth C.

(1) Inputting Work

Initially, the input chuck 31 is moved down and is on standby at the input position. A worker finds a corner portion at each opposite end of one side of a cloth C and attaches each corner portion to the input chuck 31. Meanwhile, the relay unit 40 is in the state of processing a cloth C input previously or in a standby state.

Figure 7:
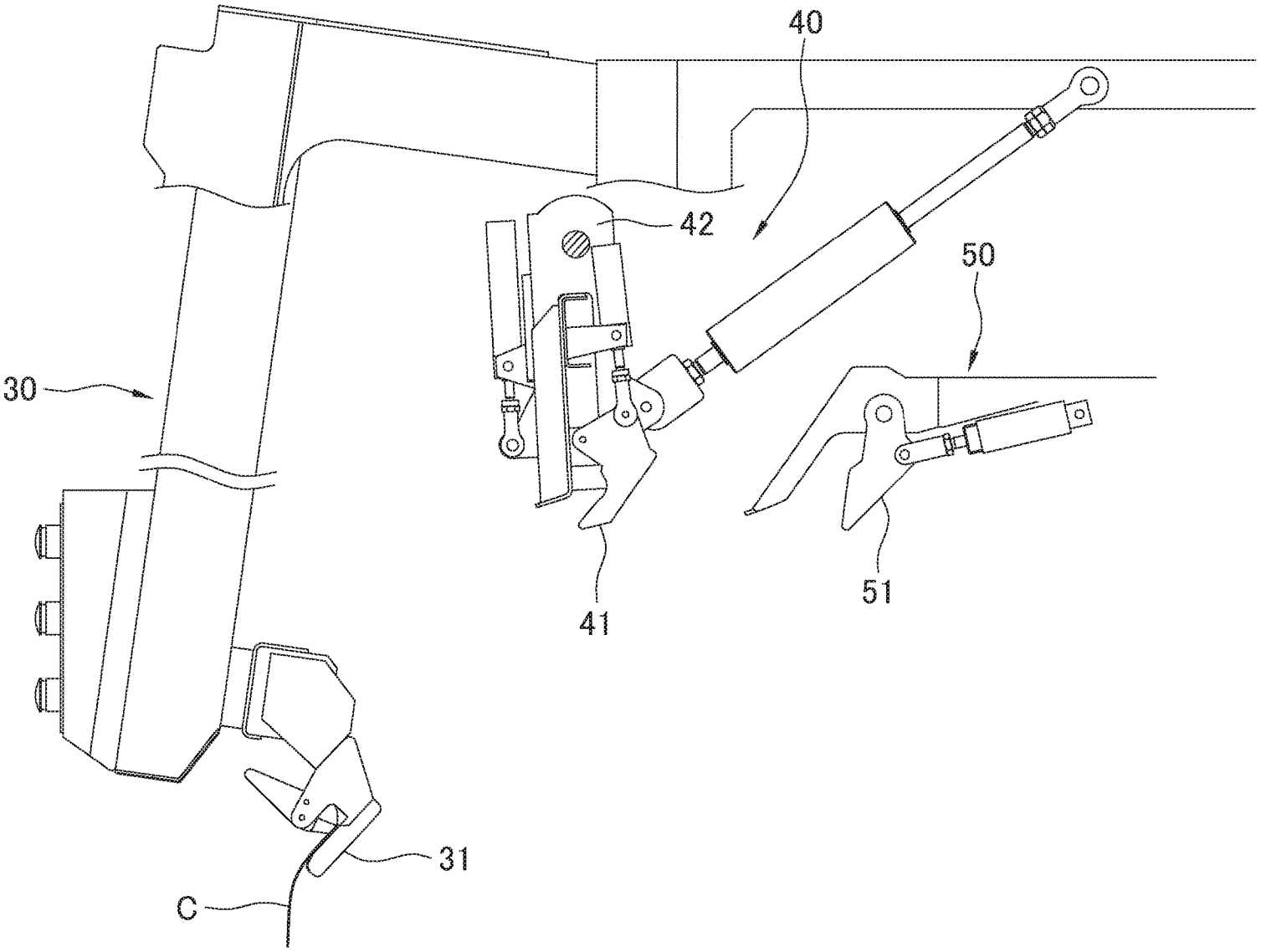
FIG. 7 is an enlarged side view showing the relay unit and its vicinity in step (1).
Figure 8:
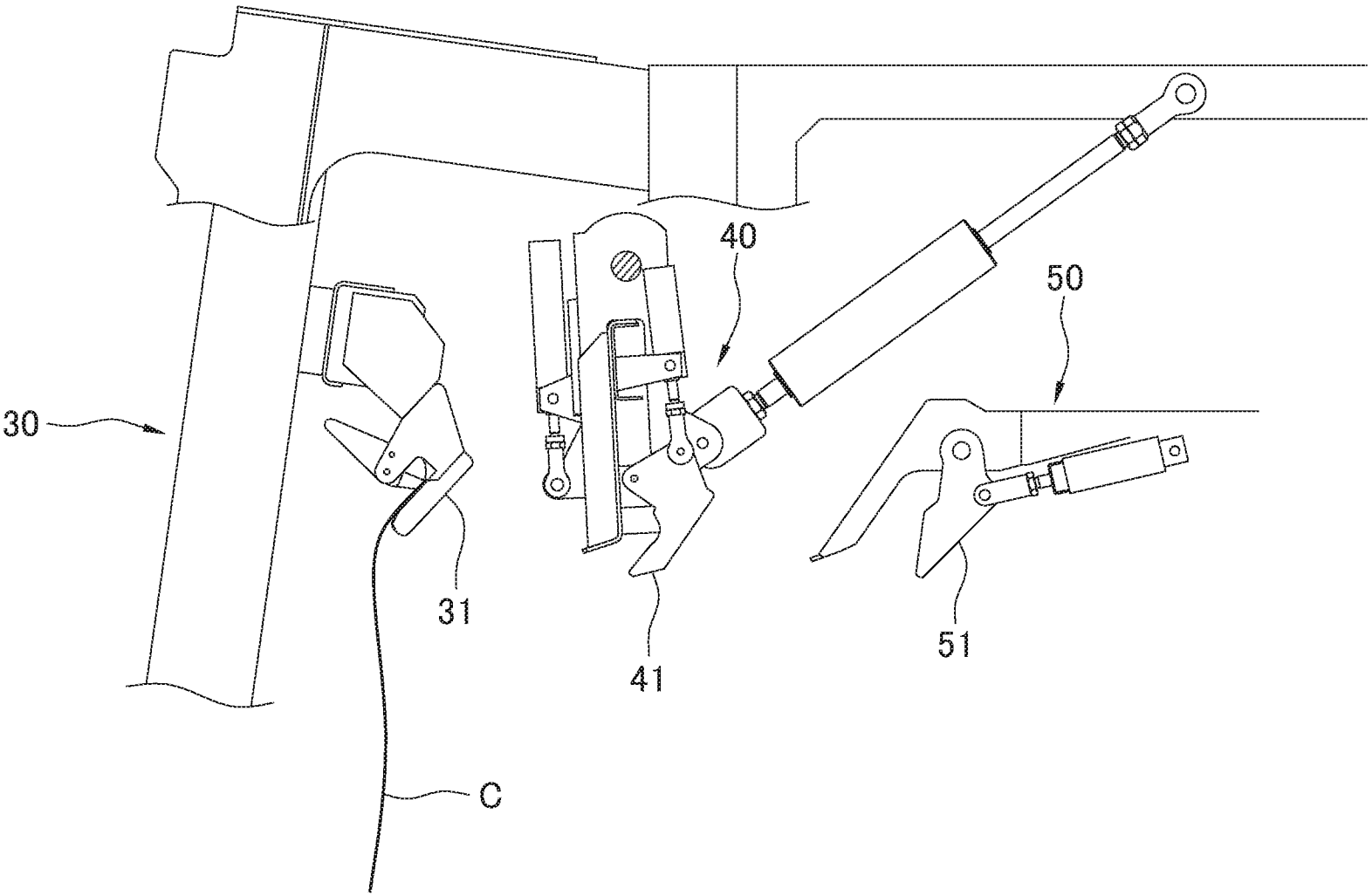
FIG. 8 is an enlarged side view showing the relay unit and its vicinity in step (2).

If the relay unit 40 is in a standby state, the circling member 42 is in a standby posture shown in FIG. 7 and the relay chuck 41 is disposed at the standby position. In this state, the relay unit 40 does not interfere with the operations of the input unit 30 and the extension unit 50. The relay chuck 41 is in an opened state, and the circling member 42 is in a contracted state. The circling member 42 is placed on standby in the standby posture until the input unit 30 becomes ready to transfer the cloth C to the relay unit 40.

(2) Upward Movement of Input Chuck

When the input chuck 31 grips the cloth C, the input chuck 31 moves up from the input position to the transfer position. By doing so, the input unit 30 becomes ready to transfer the cloth C to the relay unit 40. The relay chuck 41 is provided behind the input chuck 31 having moved up to the transfer position.

If the relay unit 40 is processing a cloth C input previously, the input chuck 31 is placed on standby at the transfer position until the processing by the relay unit 40 is finished.

(3) Forward Movement of Relay Chuck

Figure 9:
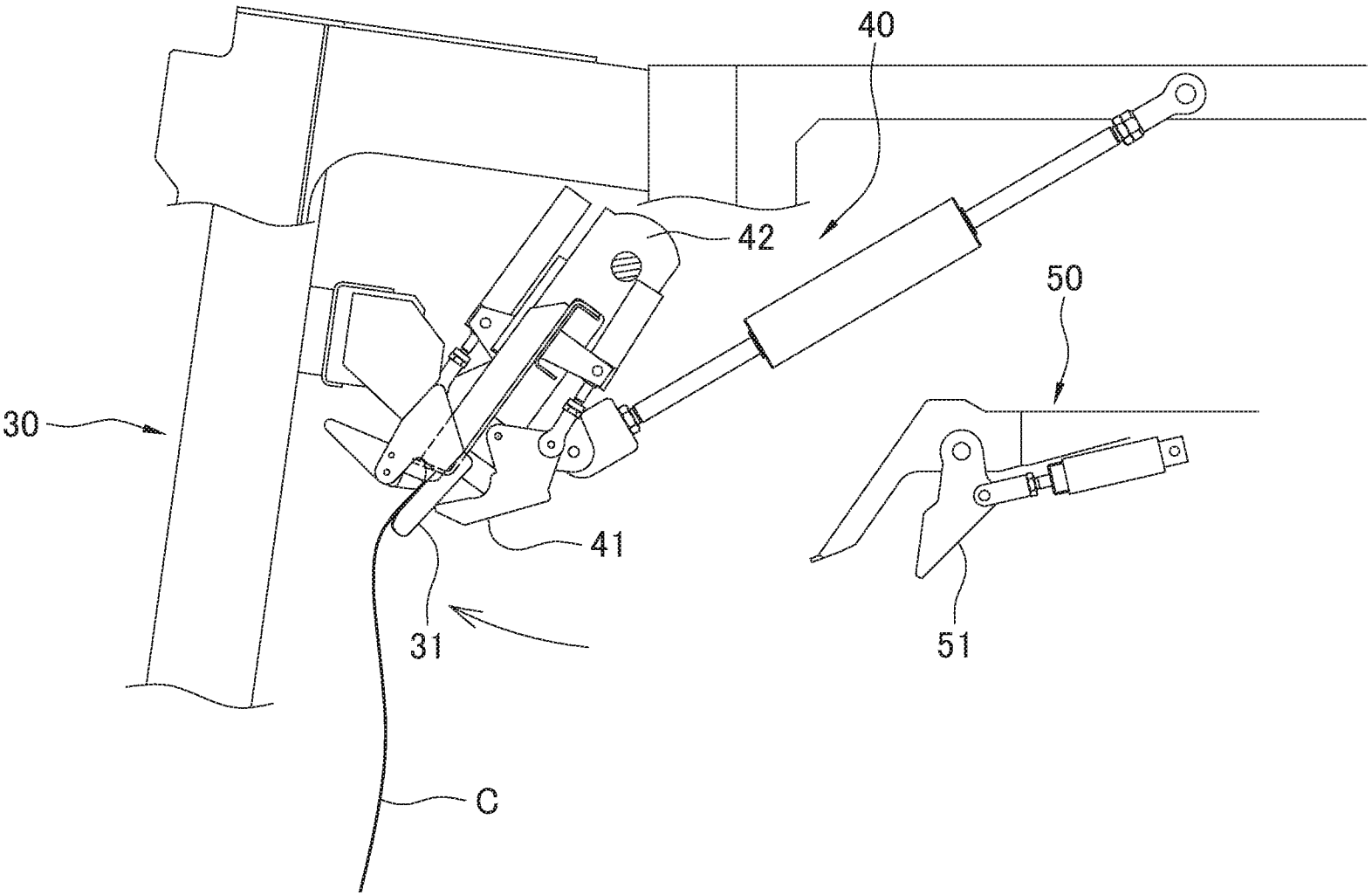
FIG. 9 is an enlarged side view showing the relay unit and its vicinity in step (3).
Figure 10:
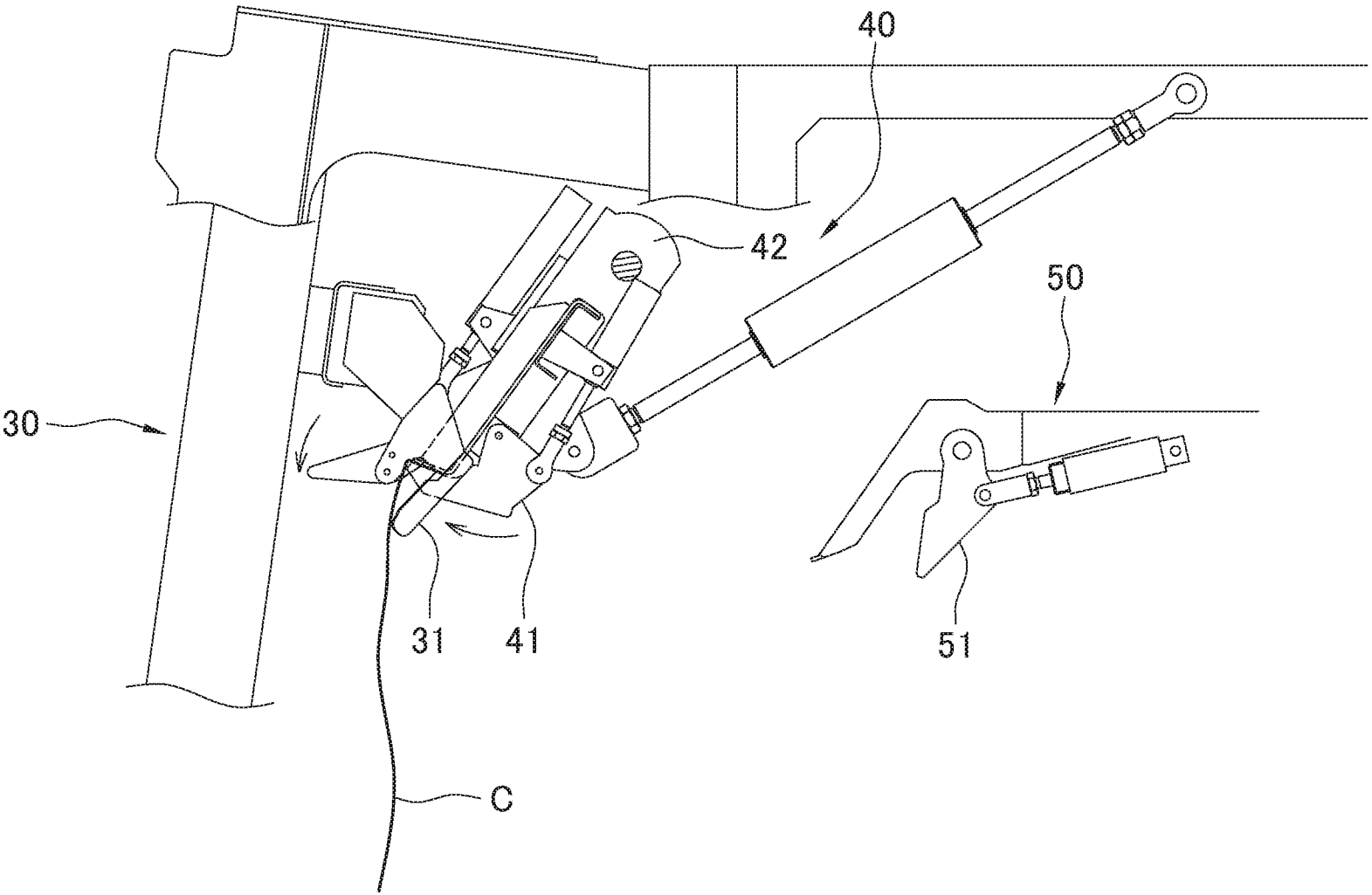
FIG. 10 is an enlarged side view showing the relay unit and its vicinity in step (4).
Figure 11:
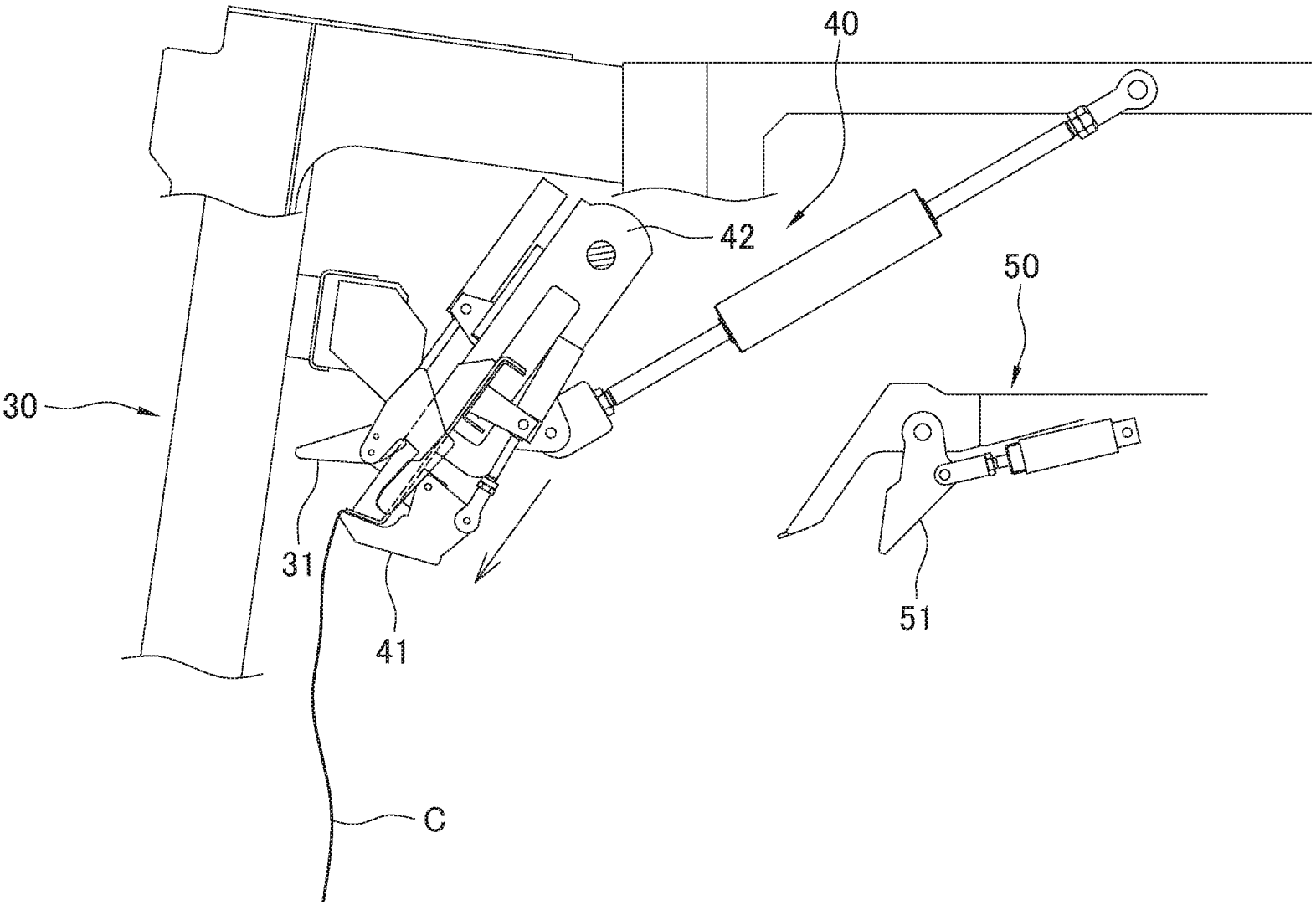
FIG. 11 is an enlarged side view showing the relay unit and its vicinity in step (5).
Figure 12:
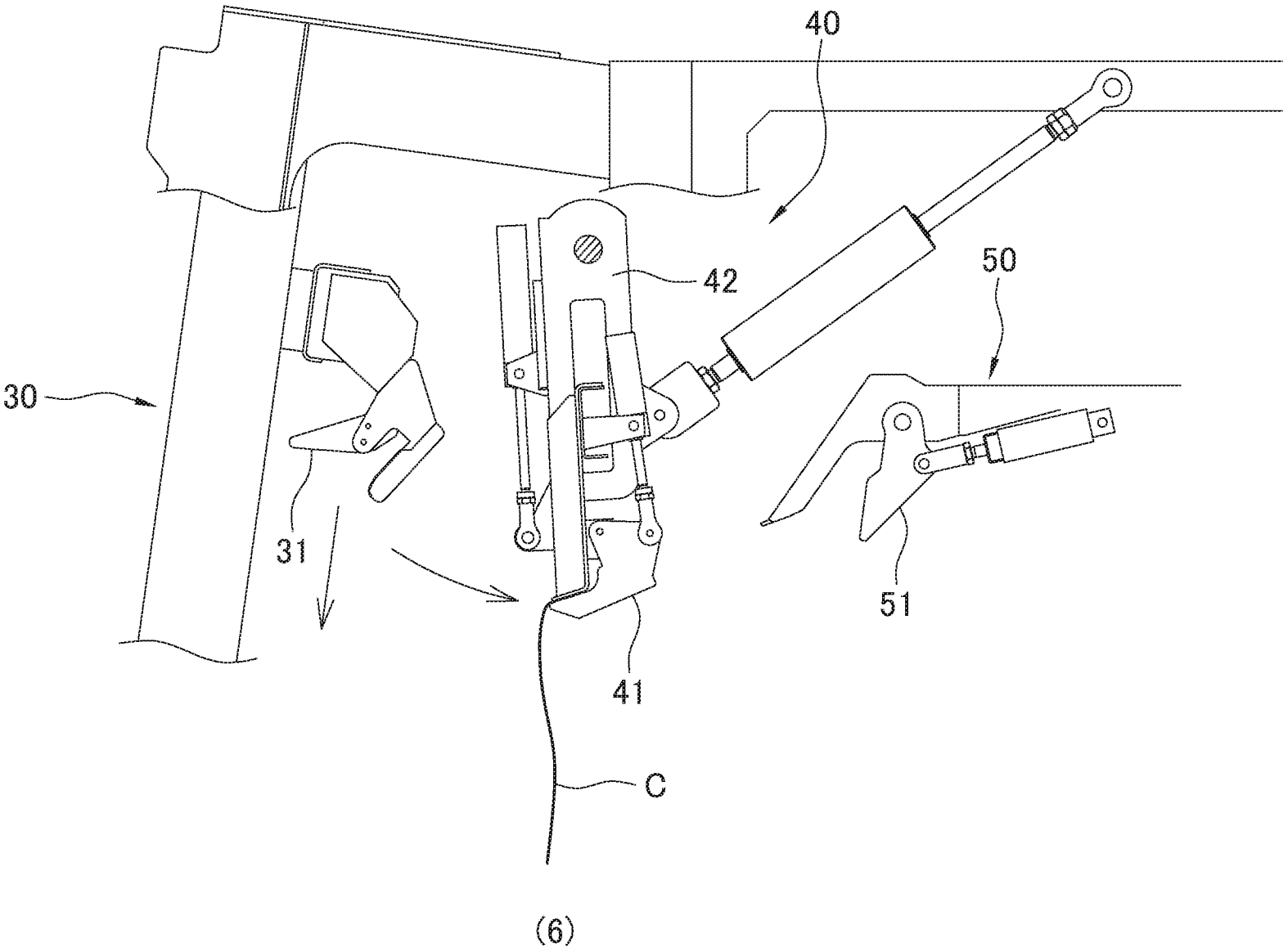
FIG. 12 is an enlarged side view showing the relay unit and its vicinity in step (6).

When the input chuck 31 has moved up to the transfer position, the circling member 42 in a contracted state circles forward. By doing so, the relay chuck 41 is disposed at the forward position. At this time, an edge of the cloth C gripped by the input chuck 31 is arranged at the open-close part of the relay chuck 41. As shown in FIG. 9, when the circling member 42 receives the cloth C from the input unit 30, the circling member 42 is in a "receiving posture."

(4) Grip by Relay Chuck

Next, the relay chuck 41 is closed to grip the edge of the cloth C with the relay chuck 41. Then, the input chuck 31 is opened to release the cloth C. In this way, the relay chuck 41 at the forward position receives the cloth C from the input unit 30.

(5) Stretch of Circling Member

Next, the circling member 42 is stretched. By doing so, the edge of the cloth C gripped by the relay chuck 41 is separated from the input chuck 31. At this time, an open-close part of the input chuck 31 is pointed in the same direction as the open-close part of the relay chuck 41. Thus, as the circling member 42 is stretched to shift the position of the relay chuck 41 outward in the radial direction of circling motion, the edge of the cloth C is extracted from the open-close part of the input chuck 31.

(6) Circling Motion of Circling Member and Downward Movement of Input Chuck

Next, the circling member 42 in a stretched state circles backward. The edge of the cloth C gripped by the relay chuck 41 has been separated from the input chuck 31 by the stretching of the circling member 42. Thus, the circling motion of the relay chuck 41 does not make the cloth C hooked on the input chuck 31. This achieves the smooth transfer of the cloth C from the input unit 30.

After the circling member 42 circles backward, the input chuck 31 moves down to the input position. By doing so, the worker becomes capable of attaching a next cloth C to the input chuck 31.

The circling member 42 circles to be placed in the standby posture to dispose the relay chuck 41 at the standby position. The circling member 42 is placed on standby in the standby posture until the extension unit 50 becomes ready to receive the cloth C. Meanwhile, the extension chucks 51, 51 in a pair move to positions behind the relay unit 40 brought to the standby state to prepare to receive the cloth C from the relay unit 40. As the relay unit 40 is in the standby state, the relay unit 40 does not interfere with the operation of the extension unit 50. The extension chuck 51 is in an opened state.

While the number of the relay units 40 is two or more, only one extension unit 50 is provided. In this regard, the extension chucks 51, 51 in a pair can move to positions behind any of the relay units 40 by moving transversely. In this way, the extension chucks 51, 51 can receive the cloth C from any relay unit 40. For example, the extension unit 50 receives cloths C from the relay units 40 in the order in which the relay units 40 gripping the cloths C are placed in the standby state.

(7) Backward Movement of Relay Chuck

Figure 13:
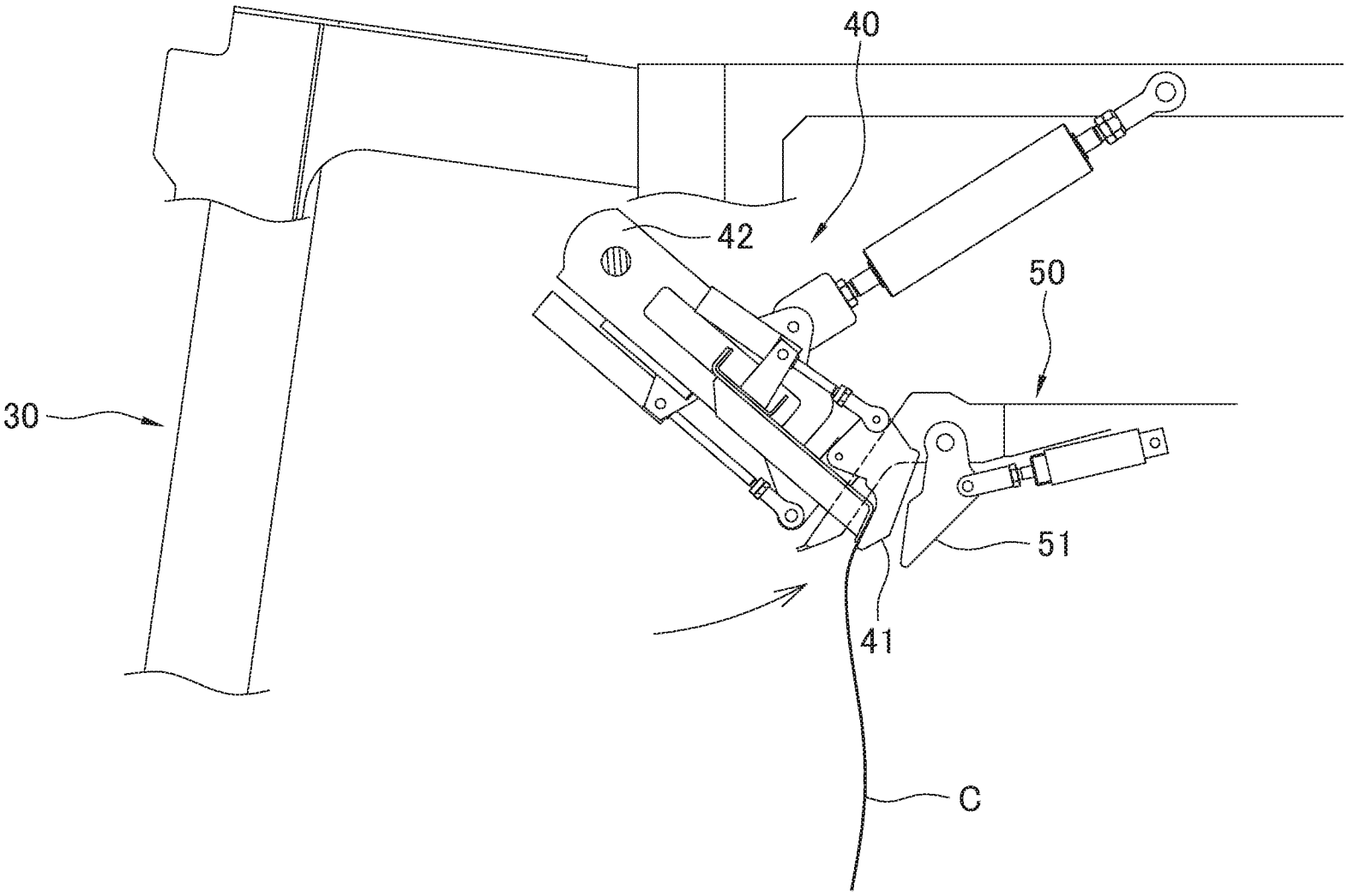
FIG. 13 is an enlarged side view showing the relay unit and its vicinity in step (7).
Figure 14:
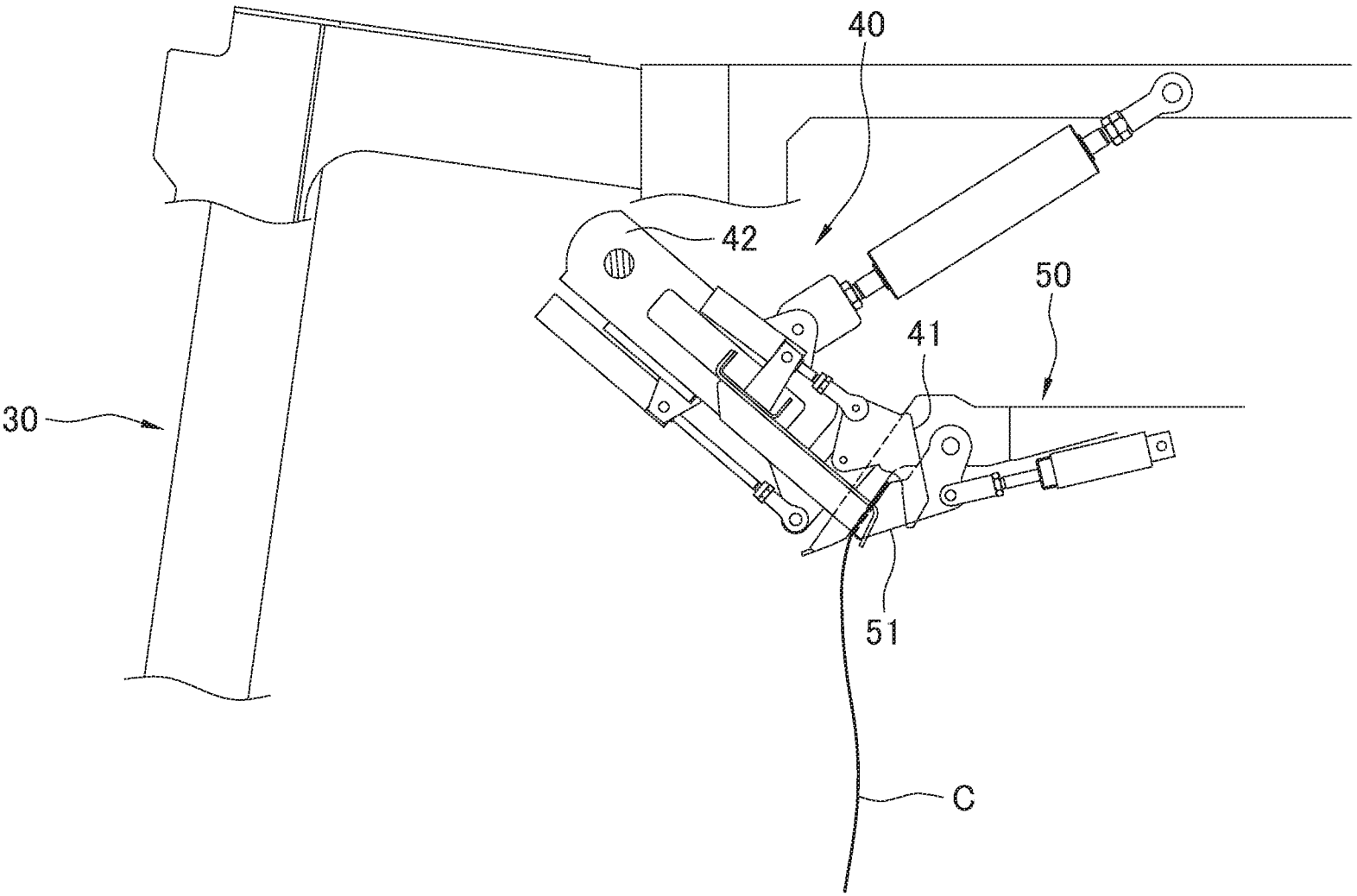
FIG. 14 is an enlarged side view showing the relay unit and its vicinity in step (8).
Figure 15:
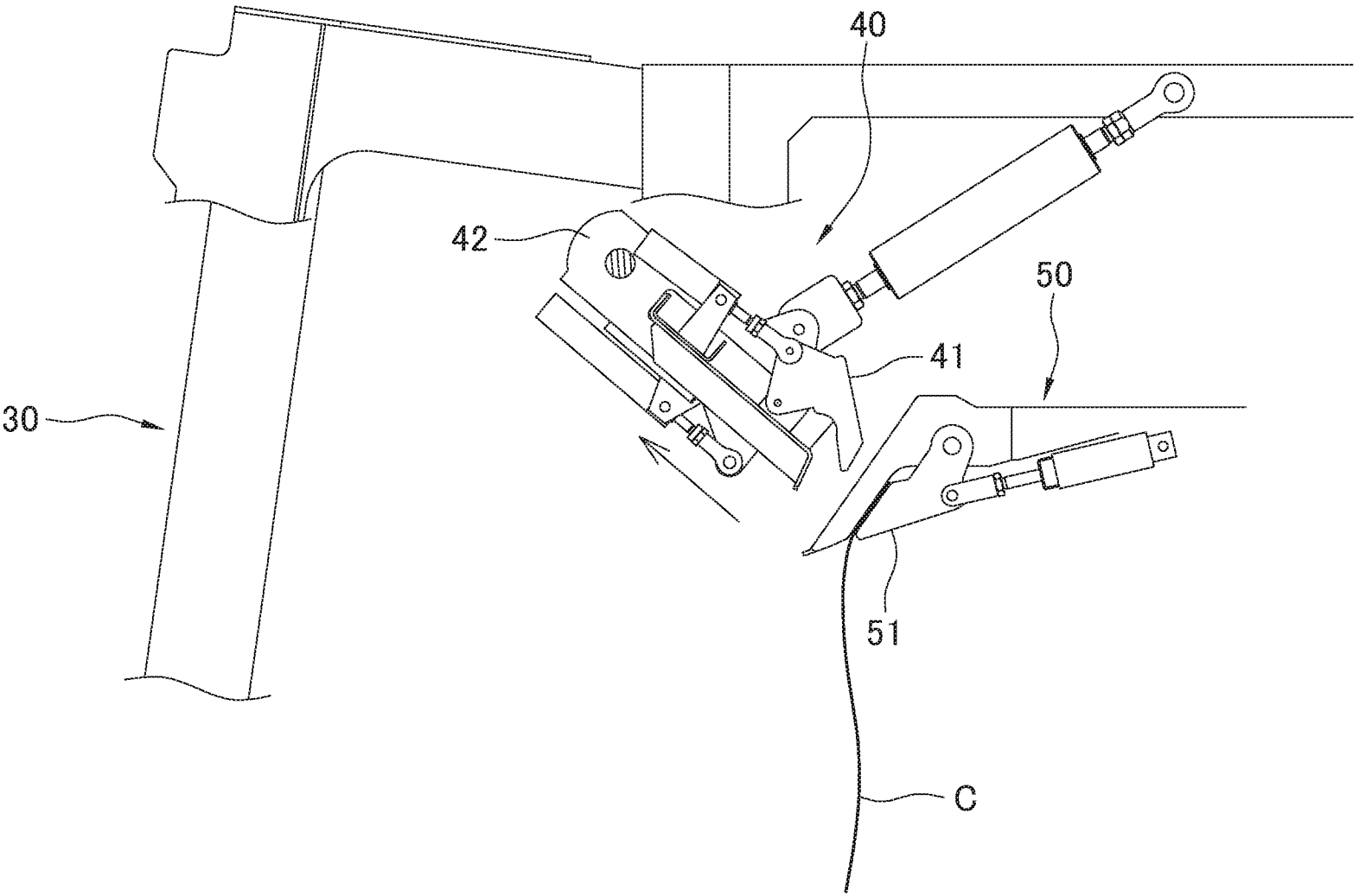
FIG. 15 is an enlarged side view showing the relay unit and its vicinity in step (9).

Next, the circling member 42 in the stretched state circles backward further. By doing so, the relay chuck 41 is disposed at the backward position. At this time, the edge of the cloth C gripped by the relay chuck 41 is inserted into an open-close part of the extension chuck 51. As shown in FIG. 13, when the circling member 42 transfers the cloth C to the extension unit 50, the circling member 42 is in a "transfer posture." The "standby posture" of the circling member 42 is a posture intermediate between the "receiving posture" and the "transfer posture" (see FIG. 12).

(8) Grip by Extension Chuck

Next, the extension chuck 51 is closed to grip the edge of the cloth C with the extension chuck 51. Then, the relay chuck 41 is opened to release the cloth C. The relay chuck 41 at the backward position transfers the cloth C to the extension unit 50. Moving the relay chuck 41 forward and backward in the foregoing way allows for the transfer of the cloth C from the input unit 30 to the extension unit 50.

(9) Contraction of Circling Member

Next, the circling member 42 is contracted. This retreats the relay chuck 41 to a position at which the relay chuck 41 does not interfere with the extension chuck 51. By doing so, interference with the operation of the extension unit 50 is avoided. Then, the circling member 42 circles to be placed in the standby posture to dispose the relay chuck 41 at the standby position.

After the circling member 42 is contracted, the extension chucks 51, 51 in a pair having received the cloth C from the relay unit 40 move transversely so as to be separated to the right and left. By doing so, the cloth C is hung in a spread state on the front side of the machine frame 10. This corresponds to the state shown in FIG. 4. Then, the cloth spreading device 1 performs the foregoing operation.

As described above, the relay unit 40 receives a cloth C from the input chuck 31 having moved up to the transfer position and transfers the received cloth C to the extension unit 50. After transferring the cloth C to the relay unit 40, the input chuck 31 moves down to the input position.

The relay unit 40 is provided for a corresponding input unit 30. This makes it possible to shorten or eliminate the standby time of the input chuck 31 until the relay unit 40 becomes ready to receive a cloth C again. Thus, the input chuck 31 can be moved down without delay to the input position. As the input chuck 31 becomes ready without delay for the inputting work, the waiting time of a worker until the next inputting work can be shortened or eliminated. As a result, the production efficiency of the cloth spreading device 1 can be increased.

OTHER EMBODIMENTS

As long as the relay unit 40 is functional as a relay for the cloth C from the input unit 30 to the extension unit 50, the configuration of the relay unit 40 is not limited to the foregoing configuration of the embodiment. For example, the relay unit 40 may be configured in such a manner that the circling member 42 is not stretched and contracted. As another example, the configuration of moving the relay chuck 41 by causing circling motion may be replaced by a configuration of moving the relay chuck 41 by causing simple linear motion.

REFERENCE SIGNS LIST

1 Cloth spreading device
20 Controller
30 Input unit
31 Input chuck
40 Relay unit
41 Relay chuck
42 Circling member
50 Extension unit
51 Extension chuck

The invention claimed is:

1. A cloth spreading device comprising:
input units for inputting of a cloth by a worker;
relay units provided corresponding to each of the input units; and
an extension unit that spreads the cloth,
wherein
each of the input units comprises:
a pair of input chucks that grips corner portions of one side of the cloth; and
an up-down moving machine that moves the pair of input chucks up and down,
the extension unit comprises:
a pair of extension chucks that grips the corner portions of the one side of the cloth; and
a transversely moving machine that transversely moves the pair of extension chucks behind the relay units,
each of the relay units comprises:
a pair of relay chucks provided behind the pair of input chucks when the pair of input chucks is moved up to a transfer position; and
a driver that moves the pair of relay chucks between a forward position at which the pair of relay chucks receives the corner portions of the cloth on the one side from the input chucks and a backward position at which the pair of relay chucks transfers the corner portions on the one side of the cloth to the pair of extension chucks, each of the relay units receives the cloth from the pair of input chucks when the pair of input chucks is moved up to the transfer position and transfers the received cloth to the pair of extension chucks, and the pair of input chucks moves down to an input position when the cloth is transferred to the relay unit.

2. The cloth spreading device according to claim 1, wherein the driver of the relay unit comprises:

a circling member with a tip portion to which the pair of relay chucks is attached; and an actuator that causes the circling member to circle.

3. The cloth spreading device according to claim 2, wherein the pair of extension chucks moves to positions behind one of the relay units and receives the cloth from the one of the relay units.

4. The cloth spreading device according to claim 2, wherein the circling member is capable of stretching and contracting in a radial direction of circling motion.

5. The cloth spreading device according to claim 4, wherein the circling member comprises:

a base having a rotary axis;

a slider to which the relay chucks are attached; and a stretchable cylinder which slides the slider relative to the base.

6. The cloth spreading device according to claim 4, wherein an open-close part of each of the relay chucks is pointed outward in the radial direction of the circling motion of the circling member.

7. The cloth spreading device according to claim 4, the cloth spreading device further comprising:

a controller, which circles the circling member in a contracted state to a receiving posture in which the circling member receives the cloth from the input units, operates the relay chucks to grip the cloth, stretches the circling member so that the cloth is separated from the pair of input chucks, and circles the circling member in a stretched state to a transfer posture in which the circling member transfers the cloth to the extension unit.

8. The cloth spreading device according to claim 7, wherein the controller circles the circling member in the stretched state to the transfer posture, operates the pair of relay chucks to release the cloth and transfers the cloth to the extension unit, and contract the circling member.

9. The cloth spreading device according to claim 7, wherein the controller places the circling member on standby in a standby posture which is a posture intermediate between the receiving posture and the transfer posture until the input unit becomes ready to transfer the cloth.

10. The cloth spreading device according to claim 7, wherein the controller places the circling member on standby in a standby posture which is a posture intermediate between the receiving posture and the transfer posture until the extension unit becomes ready to receive the cloth.

11. The cloth spreading device according to claim 1, wherein the pair of extension chucks moves to positions behind one of the relay units and receives the cloth from the one of the relay units.

* * * * *